US010247361B2

(12) United States Patent
Takahara et al.

(10) Patent No.: US 10,247,361 B2
(45) **Date of Patent: *Apr. 2, 2019**

(54) INACTIVE GAS INTRODUCING FACILITY AND INACTIVE GAS INTRODUCING METHOD

(71) Applicant: Daifuku Co., Ltd., Osaka-shi (JP)

(72) Inventors: Masahiro Takahara, Gamo-gun (JP); Toshihito Ueda, Gamo-gun (JP)

(73) Assignee: Daifuku Co., Ltd., Osaka-shi (JP)

( * ) Notice: Subject to any disclaimer, the term of this patent is extended or adjusted under 35 U.S.C. 154(b) by 64 days.

This patent is subject to a terminal disclaimer.

(21) Appl. No.: 15/234,793

(22) Filed: Aug. 11, 2016

(65) Prior Publication Data

US 2016/0348843 A1 Dec. 1, 2016

Related U.S. Application Data

(62) Division of application No. 14/300,637, filed on Jun. 10, 2014, now Pat. No. 9,453,610.

(30) Foreign Application Priority Data

Jun. 12, 2013 (JP) ..... 2013-123858

(51) Int. Cl.
*F17C 13/02* (2006.01)

(52) U.S. Cl.
CPC ..... *F17C 13/02* (2013.01); *F17C 2221/014* (2013.01); *F17C 2227/044* (2013.01); *F17C 2250/03* (2013.01); *F17C 2250/032* (2013.01); *F17C 2250/07* (2013.01); *F17C 2260/04* (2013.01); *F17C 2270/059* (2013.01); *F17C 2270/0518* (2013.01)

(58) Field of Classification Search
CPC ..... F17C 13/02; F17C 2221/014; F17C 2227/044; F17C 2250/03; F17C 2250/032; F17C 2250/0518; F17C 2270/0518; F17C 2270/059
USPC ..... 141/98
See application file for complete search history.

(56) References Cited

U.S. PATENT DOCUMENTS

2002/0124906 A1* 9/2002 Suzuki ..... H01L 21/67017 141/98
2010/0152887 A1* 6/2010 Kawasaki ..... G05B 19/409 700/228
2014/0082839 A1* 3/2014 Piombino ..... A47D 13/08 5/421
2014/0366983 A1* 12/2014 Takahara ..... F17C 13/02 141/197

(Continued)

FOREIGN PATENT DOCUMENTS

JP 2001338971 A 12/2001

*Primary Examiner* — Timothy L Maust
(74) *Attorney, Agent, or Firm* — The Webb Law Firm

(57) ABSTRACT

An inactive gas introducing facility for a storage rack is provided in which supply of inactive gas to a container is stopped if an open state of an inspection door is detected while in a normal stop state in which a stop nullifying command is not issued and in which the supply of the inactive gas based on the immediately preceding supply pattern is continued and any changes, through manual operation, to a parameter that defines the immediately preceding supply pattern are prohibited, if an open state of an inspection door is detected while in a stop nullifying state in which the stop nullifying command is issued.

2 Claims, 7 Drawing Sheets

(56) References Cited

U.S. PATENT DOCUMENTS

2015/0184102 A1* 7/2015 Mattingly ..... C10L 1/06
585/14

* cited by examiner

INACTIVE GAS INTRODUCING FACILITY AND INACTIVE GAS INTRODUCING METHOD

CROSS REFERENCE TO RELATED APPLICATION

This application is a divisional application of U.S. patent application Ser. No. 14/300,637, filed June 10, 2014, which claims priority to Japanese Patent Application No. 2013-123858 filed Jun. 12, 2013, the disclosure of which is hereby incorporated in its entirety by reference.

FIELD OF THE INVENTION

The present invention relates to an inactive gas introducing facility having a storage rack including a storage section for storing a container for storing a substrate, the storage rack being installed in storage space which is closed off from exterior space, and an introducing portion configured to act on the container which is capable of discharging gas inside the container into the storage space through a gas discharge opening when stored in the storage section, and configured to introduce inactive gas into interior of the container through a gas feed opening of the container. The present invention also relates to an inactive gas introducing method utilizing such an inactive gas introducing facility.

BACKGROUND

Such an inactive gas introducing facility for a storage rack introduces inactive gas into a container that stores substrates (for example, semiconductor wafers) in order to reduce adherence of particles to the substrates, and to reduce deterioration of the substrates from their proper state due to the presence of oxygen and humidity.

More specifically, as the inactive gas is introduced from a gas feed opening of the container that stores the substrates, gas in the container is discharged into the storage space through a gas discharge opening etc., so that the space within the container is filled with the introduced inactive gas. Thus, adherence of particles to the substrates (for example, semiconductor wafers), and deterioration of the substrates from their proper state due to the presence of oxygen or humidity are reduced.

An example of an inactive gas introducing facility for a storage rack is one in which storage locations that are arranged in vertical and horizontal directions are provided to a box-shaped storage to function as storage sections, and in which each storage location is equipped with a gas supply line which supplies nitrogen gas that functions as the inactive gas. (For example, see JP Publication of Application No. 2001-338971 (Patent Document 1)).

In addition, although no detailed description is provided in Patent Document 1, the space within the box-shaped storage corresponds to the storage space which is closed off from the exterior. And nitrogen gas is discharged from the containers into this box-shaped storage.

SUMMARY OF THE INVENTION

The inactive gas introducing facility for a storage rack commonly has an inspection door for workers to move in and out of the storage space to perform various inspections and maintenance work.

And where such an inspection door is provided, it is conceivable to stop the supply of inactive gas when the inspection door is opened, in order to prevent the inactive gas from being discharged into the storage space from the gas discharge opening of the containers stored in the storage section when a worker is in the storage space.

However, if supply of inactive gas is simply stopped whenever the inspection door is opened, inspection or maintenance work cannot be performed while the inactive gas is being supplied such as when the inactive gas is being supplied to the gas feed opening of the containers stored in the storage sections, or when the inactive gas is being released from the gas discharge opening of the containers, etc. Thus, it is desired to have an ability to provide continued supply of inactive gas even if the inspection door is opened, in addition to the ability to stop supply of the inactive gas when the inspection door is opened.

In addition, if the feed state of inactive gas is changed without the worker knowing while the worker is, for example, inspecting the feed state of the inactive gas after opening the inspection door and entering the storage space, there is a possibility that the inspection of the feed state is disrupted, and/or there may be an increase in the discharged amount of the inactive gas into the storage space.

Accordingly, an inactive gas introducing facility for a storage rack is desired in which supply state of inactive gas is not changed during inspection work, in addition to the ability to allow inspection work to be performed while the supply of inactive gas is stopped.

An inactive gas introducing facility in accordance with the present invention comprises:

a storage rack including a storage section for storing a container for storing a substrate, the storage rack being installed in storage space which is closed off from exterior space;

an introducing portion configured to act on the container which is capable of discharging gas inside the container into the storage space through a gas discharge opening when stored in the storage section, and configured to introduce inactive gas into interior of the container through a gas feed opening of the container;

an introducing controller for controlling supply of the inactive gas to the container by controlling an operation of the introducing portion based on a supply pattern defined by a predetermined parameter; an inspection door open-and-close detector for detecting whether an inspection door for allowing a worker to go in, and out of, the storage space is in an open state or a closed state; and a manually-operated stop nullifying command portion for issuing a stop nullifying command;

wherein the introducing controller is configured: to stop the supply of the inactive gas to the container by stopping supply control of inactive gas based on an immediately preceding supply pattern which is the supply pattern that was being performed before the open state of the inspection door was detected, if the open state of the inspection door is detected by the inspection door open-and-close detector while in a normal stop state in which the stop nullifying command is not issued from the stop nullifying command portion; and to continue with the supply of the inactive gas based on the immediately preceding supply pattern and to prohibit any changes, through manual operation, to the parameter that defines the immediately preceding supply pattern if an open state of the inspection door is detected by the inspection door open-and-close detector while in a stop nullifying state in which the stop nullifying command is issued from the stop nullifying command portion.

With this arrangement, the supply of the inactive gas to the container is stopped by stopping supply control of the inactive gas based on the immediately preceding supply pattern which is the supply pattern that was being performed before the open state of the inspection door was detected, if the open state of the inspection door is detected by the inspection door open-and-close detector while in a normal stop state in which the stop nullifying command is not issued from the stop nullifying command portion.

On the other hand, the supply of the inactive gas is continued based on the immediately preceding supply pattern and any changes, through manual operation, to the parameter that defines the immediately preceding supply pattern are prohibited, even if the open state of the inspection door is detected by the inspection door open-and-close detector while in the stop nullifying state in which the stop nullifying command is issued from the stop nullifying command portion.

Thus, when inspecting, as the inspection work, for example, the feeding of inactive gas to the gas feed opening of the container stored in the storage section and discharging of the inactive gas through the gas discharge opening of the container while the inactive gas is being supplied, a worker can operate the stop nullifying command portion to cause the stop nullifying command to be issued so that the supply of the inactive gas to the container based on the supply pattern, that was being performed before the state of the inspection door was changed to the open state, is continued even if the inspection door is opened, and so that the inspection work can be performed while the supply of the inactive gas to the container based on the supply pattern is continued.

At this time, even if, for example, another worker outside the storage space attempts to change the parameter that defines the supply pattern of the inactive gas, the feed state of the inactive gas cannot be changed since any changes to the parameter is prohibited. Therefore, disruption of inspection of the feed state, and/or increase in the discharged amount of the inactive gas into the storage space, due to the changes in the feed state of inactive gas without the worker knowing, can be prevented.

On the other hand, if the continued supply of the inactive gas to the container is not required for the inspection work, a worker can open the inspection door without causing the stop nullifying command portion to issue the stop nullifying command so that the supply of the inactive gas to the container is stopped and so that the inspection work can be performed while the supply of the inactive gas to the container is stopped.

Thus, an inactive gas introducing facility for a storage rack can be provided in which inspection work can be performed while the supply of the inactive gas, based on the supply pattern that was being performed before the inspection door was opened, is continued and without being changed, in addition to providing the ability to allow inspection work to be performed while the supply of inactive gas is stopped.

The inactive gas introducing method also has the technical features of the inactive gas introducing facility in accordance with the present invention. And such method is considered to be within the scope of the present invention. The inactive gas introducing method also has the functions and effects of the inactive gas introducing facility described above.

More specifically, the inactive gas introducing method in accordance with the present invention is a method that utilizes an inactive gas introducing facility having a storage rack including a storage section for storing a container for storing a substrate, the storage rack being installed in storage space which is closed off from exterior space; an introducing portion configured to act on the container which is capable of discharging gas inside the container into the storage space through a gas discharge opening when stored in the storage section, and configured to introduce inactive gas into interior of the container through a gas feed opening of the container; an introducing controller for controlling supply of the inactive gas to the container by controlling an operation of the introducing portion based on a supply pattern defined by a predetermined parameter; and an inspection door open-and-close detector for detecting whether an inspection door for allowing a worker to go in, and out of, the storage space is in an open state or a closed state; and a manually-operated stop nullifying command portion for issuing a stop nullifying command. And the inactive introducing method comprises the following step that is performed by the introducing controller: an introducing control step: in which the supply of the inactive gas to the container is stopped by stopping supply control of inactive gas based on an immediately preceding supply pattern which is the supply pattern that was being performed before the open state of the inspection door was detected, if an open state of the inspection door is detected by the inspection door open-and-close detector while in a normal stop state in which the stop nullifying command is not issued from the stop nullifying command portion; and in which the supply of the inactive gas based on the immediately preceding supply pattern is continued, and any changes, through manual operation, to the parameter that defines the immediately preceding supply pattern are prohibited, if an open state of the inspection door is detected by the inspection door open-and-close detector while in a stop nullifying state in which the stop nullifying command is issued from the stop nullifying command portion.

Examples of preferred embodiments of the present invention are described next.

In an embodiment of the inactive gas introducing facility in accordance with the present invention, the introducing controller is preferably further configured to prohibit any changes, by remote control from outside, to the parameter that defines the immediately preceding supply pattern if the open state of the inspection door is detected while in the stop nullifying state.

Because it is difficult to see, by remote control from the outside, how the work is performed by a worker in the storage space, there is a possibility that the parameter that defines the supply pattern can be changed regardless of how the work is being performed by the worker. Therefore, for example, there is a possibility that the amount of discharge of the inactive gas into the storage space is increased rapidly by remote control from the outside when there is a worker in the storage space. With the arrangement described above, even if an attempt is made to change the parameter that defines the immediately preceding supply pattern by remote control from the outside when the worker is performing inspection work in the storage space while the supply of the inactive gas to the container based on the immediately preceding supply pattern is continued, any changes to the parameter are prohibited; thus, any changes to the parameter can be prevented. Therefore, disruption of the inspection work of the feed state and/or increase in the amount of discharge of the inactive gas into the storage space, due to changes in the feed state of the inactive gas by remote control from the outside without the worker knowing, can be prevented.

In addition, in an embodiment of the inactive gas introducing facility in accordance with the present invention, the inactive gas introducing facility preferably further comprises an oxygen concentration detection sensor for detecting oxygen concentration within the storage space, wherein the introducing controller is preferably configured to stop the supply of the inactive gas to the container by stopping the supply control of the inactive gas based on the immediately preceding supply pattern, if the oxygen concentration detected by the oxygen concentration detection sensor becomes less than a preset value defined in advance when the introducing controller is continuing with the supply of the inactive gas based on the immediately preceding supply pattern in the stop nullifying state.

With this arrangement, the supply of the inactive gas to the container is stopped by stopping the supply control of the inactive gas based on the immediately preceding supply pattern which is the supply patter that was being performed before the inspection door was opened, if the oxygen concentration detected by the oxygen concentration detection sensor becomes less than the preset value when the supply of the inactive gas based on the immediately preceding supply pattern is continued in the stop nullifying state.

Therefore, the supply of the inactive gas to the container can be stopped to ensure safety of the worker in the event that the oxygen concentration in the storage space becomes less than the preset value due to discharging of the inactive gas from the gas discharge opening of the container, etc. into the storage space in the stop nullifying state.

More specifically, the storage space is not completely sealed so that the gas discharged from the container can be released to the exterior space; thus, the storage space is opened to the exterior space to allow movement of air and gas as necessary. Also, the inspection door is often kept open when performing inspection work so that the oxygen concentration in the storage space does not normally fall to less than the preset value even if the inactive gas is discharged from the gas discharge opening of the container, etc., into the storage space. However, even if the oxygen concentration within storage space should become less than the preset value, the safety of the worker can still be reliably secured by stopping the supply of the inactive gas to the container.

In addition, in an embodiment of the inactive gas introducing facility in accordance with the present invention, the introducing controller is preferably configured to activate a notifying member for notifying a worker of continued supply of the inactive gas when the introducing controller is continuing with the supply of the inactive gas based on the immediately preceding supply pattern in the stop nullifying state.

With this arrangement, a worker is notified of the continued supply of the inactive gas by the notifying member when the supply of inactive gas based on the supply pattern, which was being performed before the state of the inspection door was changed to the open state, is continued even if the open state of the inspection door is detected by the inspection door open-and-close detector while in the stop nullifying state.

Therefore, because a worker can reliably know that the supply of the inactive gas to the container is continued when performing inspection work in the storage space, the worker can perform the inspection work with full knowledge that the supply of the inactive gas to the container is being continued.

An arrangement may be adapted in which, for example, the notifying member transmits a notification, that the supply of inactive gas is continued, to a mobile receiver, such as a mobile phone carried by the worker, or in which a loudspeaker is installed near the inspection door for notifying of the continued supply of the inactive gas.

In addition, in an embodiment of the inactive gas introducing facility in accordance with the present invention, the introducing controller is preferably configured to set the stop nullifying state if the stop nullifying command is issued from the stop nullifying command portion, and to cancel the stop nullifying state and switch to the normal stop state if the open state of the inspection door is not detected by the inspection door open-and-close detector within a set period defined in advance after the stop nullifying state is set.

With this arrangement, even when the stop nullifying state is set after the stop nullifying command is issued from the stop nullifying command portion, the stop nullifying state is cancelled and is replaced by the normal stop state if the open state of the inspection door is not detected by the inspection door open-and-close detector within a set period defined in advance after the stop nullifying state is set.

Thus, even if a worker causes the stop nullifying command portion to issue the stop nullifying command in order to perform inspection work while the supply of the inactive gas to the container is continued, and even if, subsequently, for example, the worker decides to stop the inspection work for some reason, unnecessary continuance of the stop nullifying state can be avoided since the stop nullifying state is canceled automatically and is replaced by the normal stop state.

If the arrangement was such that the stop nullifying state would continue indefinitely, there would be a possibility that a worker, who has not noticed that the facility is in the stop nullifying state, may enter the storage space without noticing that the facility is in the stop nullifying state, and believing that the supply of inactive gas would be stopped if the inspection door is opened while in the normal stop state. In such a case, the supply of the inactive gas would not be stopped even when a worker opens the inspection door and the supply of the inactive gas to the container would be continued unintentionally. To this end, with the arrangement described above, if a set period defined in advance elapses after the stop nullifying state is set without the inspection door being opened, the stop nullifying state is canceled, and is replaced by the normal stop state; thus, the possibility of a worker entering the storage space, without noticing that the system is actually in the stop nullifying state despite the fact that the facility is in the stop nullifying state, is reduced.

In addition, in an embodiment of the inactive gas introducing facility in accordance with the present invention, the stop nullifying command portion is preferably configured to be operated by an operating member which can be operated between an operation release position and a nullifying command position, and is configured to issue the stop nullifying command when the operating member is operated to the nullifying command position wherein the operating member is urged back toward the operation release position.

With the arrangement described above, the stop nullifying command can be issued by operating the operating member from the operation release position to the nullifying command position. In addition, the operating member operated to the nullifying command position is returned to the operation release position by the urging force back toward the operation release position upon being released by hand; thus the operating member can be prevented from being unintentionally left in the nullifying command position. Therefore, unnecessary continuance of the stop nullifying state can be avoided.

In addition, if the operating member were to remain in the nullifying command position even if inspection door is not opened within the set period after the stop nullifying state is set so that the stop nullifying state is canceled and is automatically replaced by the normal stop state, as described above, then there would be a possibility that the worker may mistakenly believe that the facility is in the stop nullifying state. However, with the arrangement described above, since the operating member is returned to the operation release position by the urging force, the worker is prevented from mistakenly believing that the system is in the stop nullifying state.

In addition, in an embodiment of the inactive gas introducing method in accordance with the present invention, in the introducing control step, any changes, by remote control from outside, to the parameter that defines the immediately preceding supply pattern are preferably further prohibited if the open state of the inspection door is detected while in the stop nullifying state.

In addition, in an embodiment of the inactive gas introducing method in accordance with the present invention, the inactive gas introducing facility preferably further comprises an oxygen concentration detection sensor for detecting oxygen concentration within the storage space, wherein, in the introducing control step, the supply of the inactive gas to the container is stopped by stopping the supply control of the inactive gas based on the immediately preceding supply pattern, if the oxygen concentration detected by the oxygen concentration detection sensor becomes less than a preset value defined in advance when the supply of the inactive gas based on the immediately preceding supply pattern in the stop nullifying state is continued.

In addition, in an embodiment of the inactive gas introducing method in accordance with the present invention, in the introducing control step, a notifying member for notifying a worker of continued supply of the inactive gas is preferably activated when the supply of the inactive gas based on the immediately preceding supply pattern is continued in the stop nullifying state.

In addition, in an embodiment of the inactive gas introducing method in accordance with the present invention, in the introducing control step, the stop nullifying state is preferably set if the stop nullifying command is issued from the stop nullifying command portion, and wherein the stop nullifying state is preferably cancelled and is preferably replaced by the normal stop state, if the open state of the inspection door is not detected by the inspection door open-and-close detector within a set period defined in advance after the stop nullifying state is set.

In addition, in an embodiment of the inactive gas introducing method in accordance with the present invention, the stop nullifying command portion is preferably configured to be operated by an operating member which can be operated between an operation release position and a nullifying command position, and is preferably configured to issue the stop nullifying command when the operating member is operated to the nullifying command position wherein the operating member is urged back toward the operation release position.

DETAILED DESCRIPTION

Figure 1:
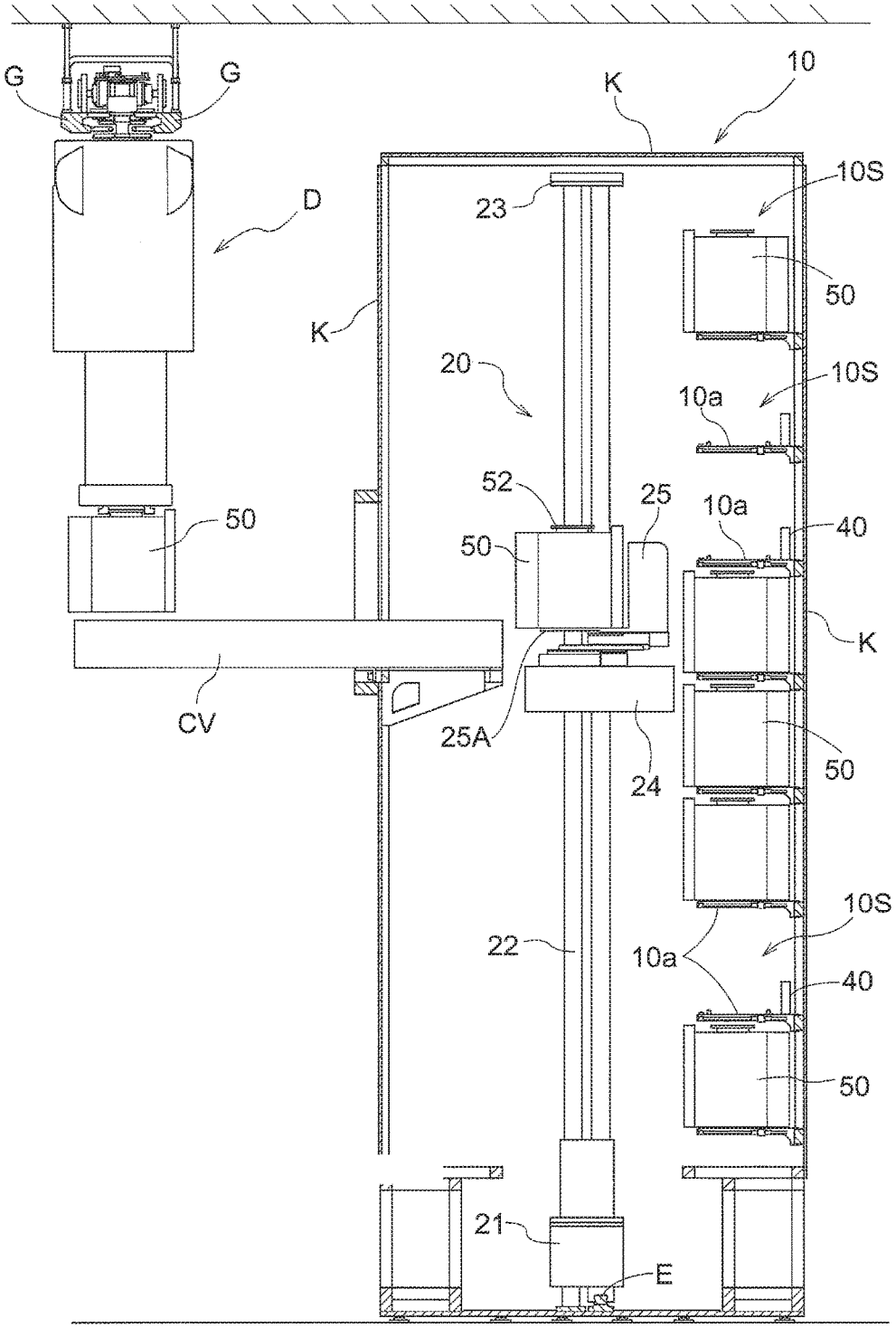
FIG. 1 is a vertical sectional front view of an article storage facility having a storage rack in accordance with an embodiment of the present invention.

An embodiment of an inactive gas introducing facility 1 for a storage rack (referred to hereinafter as the inactive gas introducing facility 1) in accordance with the present invention is described next.

The inactive gas introducing facility 1 includes a storage rack 10 which stores containers 50 (to be transported) for storing substrates (referred to hereafter as containers for short), and introducing portions N each of which introduces, or injects, inactive gas into the associated container 50 stored in the storage rack 10. In the present embodiment, the storage rack 10 defines a part of an article storage facility. Details are described next.

1. Article Storage Facility

Figure 2:
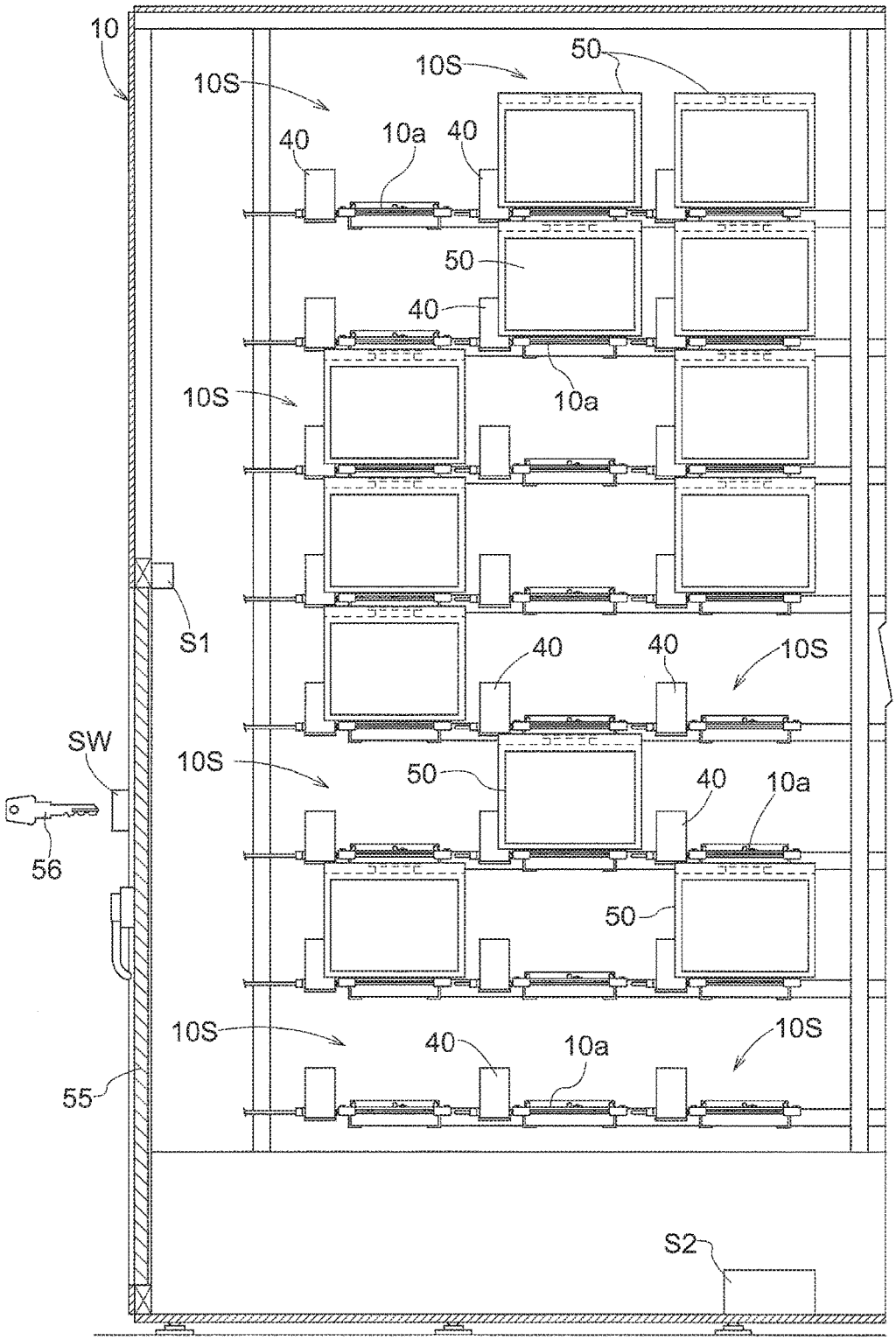
FIG. 2 is a cut-out side view of the article storage facility in accordance with the embodiment of the present invention.

As shown in FIGS. 1 and 2, the article storage facility includes a storage rack 10 which stores the containers 50 each of which store substrates in an air-tight environment, a stacker crane 20 which functions as a transport portion, and an carry-in-and-out conveyor CV which functions as a carry-in-and-out section for the containers 50.

The storage rack 10 and the stacker crane 20 are located in the storage space which is blocked off, or closed off, by walls K from the exterior. And the carry-in-and-out conveyor CV is arranged to extend through a wall K.

The storage rack 10 includes a plurality of storage sections 10S each of which functions as a support portion for supporting a container 50 such that the storage sections 10S are arranged in vertical columns and lateral or horizontal rows. Each of the plurality of storage sections 10S is configured to store, or accommodate, a container 50, details of which will be described below.

And as shown in FIG. 1, in the present embodiment, a hoist type transport vehicle D which travels along guide rails G installed to a ceiling area of a clean room in which the article storage facility is installed is provided. This hoist type transport vehicle D is configured to carry in a container 50 to, and carry out a container 50 from, the carry-in-and-out conveyor CV.

1-1. Container 50

Each container 50 is an airtight container that is made of synthetic resin, and that is in compliance with SEMI (Semiconductor Equipment and Materials International) standard. The container 50 is commonly referred to as a FOUP (Front Opening Unified Pod), and is used to store semiconductor wafers W (see FIG. 4) which are substrates. And although detailed description is omitted, formed in the front face of the container 50 is an opening, for inserting and removing substrates, which is opened and closed by a removable lid. And as shown in FIG. 1, formed on the top surface of the container 50 is a top flange 52 (see FIG. 4) which is configured to be gripped or held by the hoist type transport vehicle D. Three engaging grooves (not shown) with which the positioning pins 10*b* (see FIG. 3) engage are formed in the bottom surface of the container 50.

Figure 4:
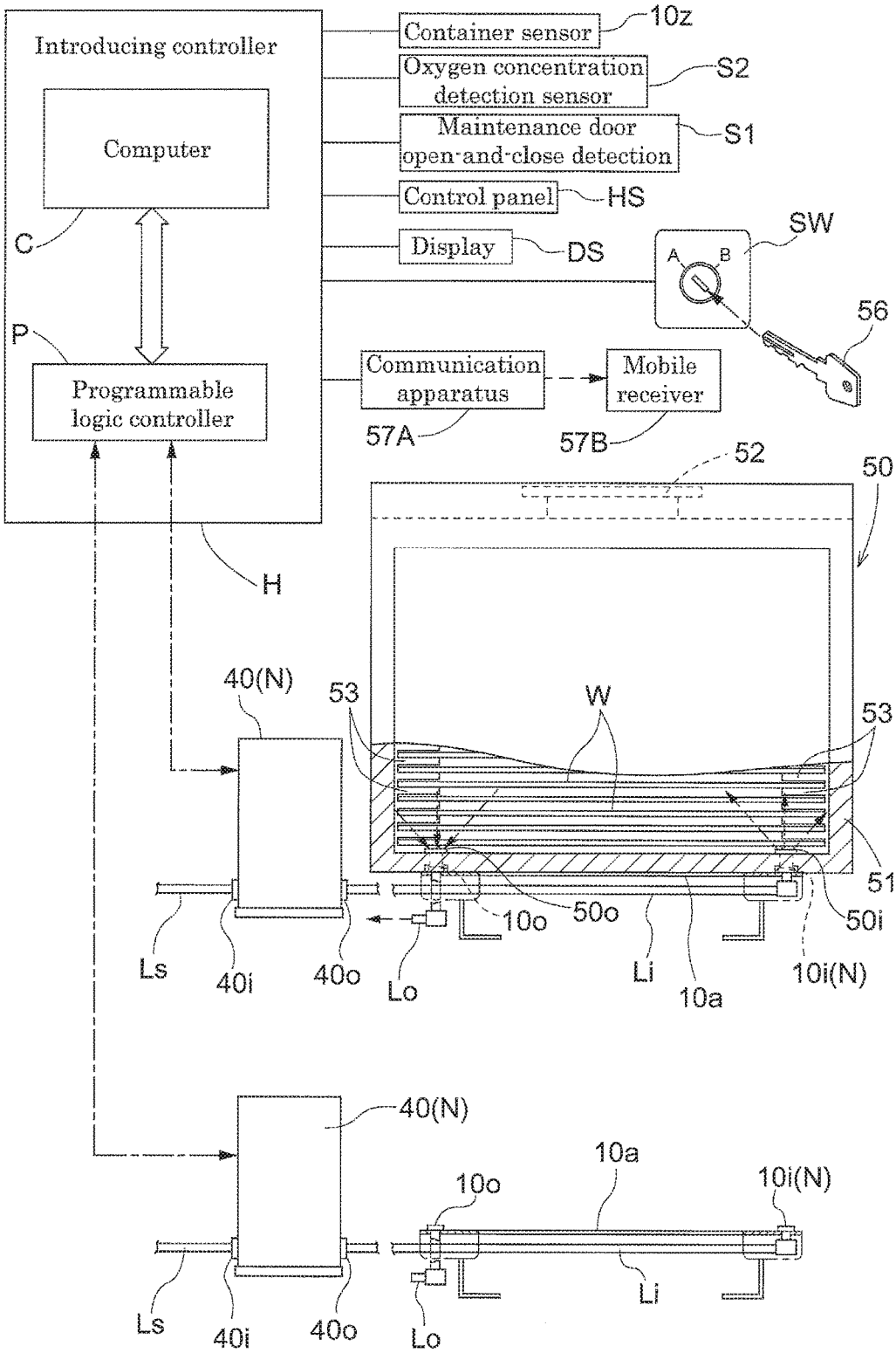
FIG. 4 is an explanatory drawing which shows a schematic structure of an introducing portion and an introducing controller in accordance with the embodiment of the present invention.

That is, as shown in FIG. 4, the container 50 includes a lid (not shown), and a casing 51 which includes substrate supports 53 within the casing 51 for supporting a plurality of semiconductor wafers W such that the semiconductor wafers W are arranged, or spaced apart, in the vertical direction. And the container 50 is configured such that its interior space is sealed to provide an air-tight environment when the lid is attached to the casing 51 and closed, and is also configured to be properly positioned in place by means of the positioning pins 10*b* when stored in a storage section 10S.

The container 50 has a gas feed opening 50*i* for introducing, or injecting, nitrogen gas as the inactive gas, as well as a gas discharge opening 50*o*. And when stored in a storage section 10S, the container 50 is configured to discharge gas that has been previously present in the container from the gas discharge opening 50*o* into the storage space when nitrogen gas is introduced through the gas feed opening 50*i*.

In the present embodiment, the gas feed opening 50*i* and the gas discharge opening 50*o* are provided in the bottom portion of the container 50. And while not shown, the gas feed opening 50*i* has an introducing side opening and closing valve whereas the gas discharge opening 50*o* has a discharging side opening and closing valve.

The introducing side opening and closing valve is urged in the closing direction, or toward its closed position, by an urging mechanism, such as a spring. And when the discharge pressure of the nitrogen gas supplied to the gas feed opening 50*i* is greater than or equal to a set valve opening pressure which is greater than the atmospheric pressure by a preset value, the introducing side opening and closing valve is configured to be opened by this pressure.

Also, the discharging side opening and closing valve is urged in the closing direction, or toward its closed position, by an urging mechanism, such as a spring. And when the pressure inside the container 50 is greater than or equal to a set valve opening pressure which is greater than the atmospheric pressure by a preset value, the discharge side opening and closing valve is configured to be opened by this pressure.

1-2. Stacker Crane 20

As shown in FIG. 1, the stacker crane 20 includes a travel carriage 21 which can travel along a travel rail E installed on the floor on the side of the front face of the storage rack 10, a mast 22 mounted erect on the travel carriage 21, and a vertically movable platform 24 which can be moved up and down, or raised or lowered, while guided by the mast 22.

The upper frame 23 which is provided in an upper end of the mast 22 is configured to move while engaging an upper guide rail (not shown) provided on the ceiling side of the storage space surrounded by the walls K.

A transfer device 25 for transferring the container 50 to or from the storage section 10S is mounted on the vertically movable platform 24.

The transfer device 25 includes a plate-shaped support body 25A for receiving and supporting the container 50 such that the support body 25A can be projected to a projected position at which the support body 25A is projected to inside the storage section 10S, and can be retracted to a retracted position at which the support body 25A is retracted toward the vertically movable platform 24. And the transfer device 25 is configured to perform an unloading operation in which the container 50 placed on the support body 25A is unloaded onto the storage section 10S as well as a retrieval operation in which a container 50 stored in a storage section 10S is retrieved, or picked up, by projecting and retracting the support body 25A, and vertically moving the vertically movable platform 24.

In addition, the transfer device 25 also performs transfer operations to and from the carry-in-and-out conveyor CV by performing the unloading operation and the retrieval operation to the carry-in-and-out conveyor CV.

While not shown, the stacker crane 20 has a travel position detector which detects the travel position in the travel path, and a vertical position detector which detects the vertical position of the vertically movable platform 24. And the crane controller (not shown) for controlling the operation of the stacker crane 20 is configured to control operation of the stacker crane 20 based on the detected information from the travel position detector and the vertical position detector.

That is, the crane controller is configured to control the traveling operation of the travel carriage 21, and the vertical movement operation of the vertically movable platform 24 as well as the projecting and retracting operation of the support body 25A of the transfer device 25, in order to perform a carry-in operation in which a container 50 carried into the carry-in-and-out conveyor CV is stored in a storage section 10S, and to perform a carry-out operation in which a container 50 stored in a storage section 10S is carried out, or taken out to the carry-in-and-out conveyor CV.

1-3. Storage Section 10S

Figure 3:
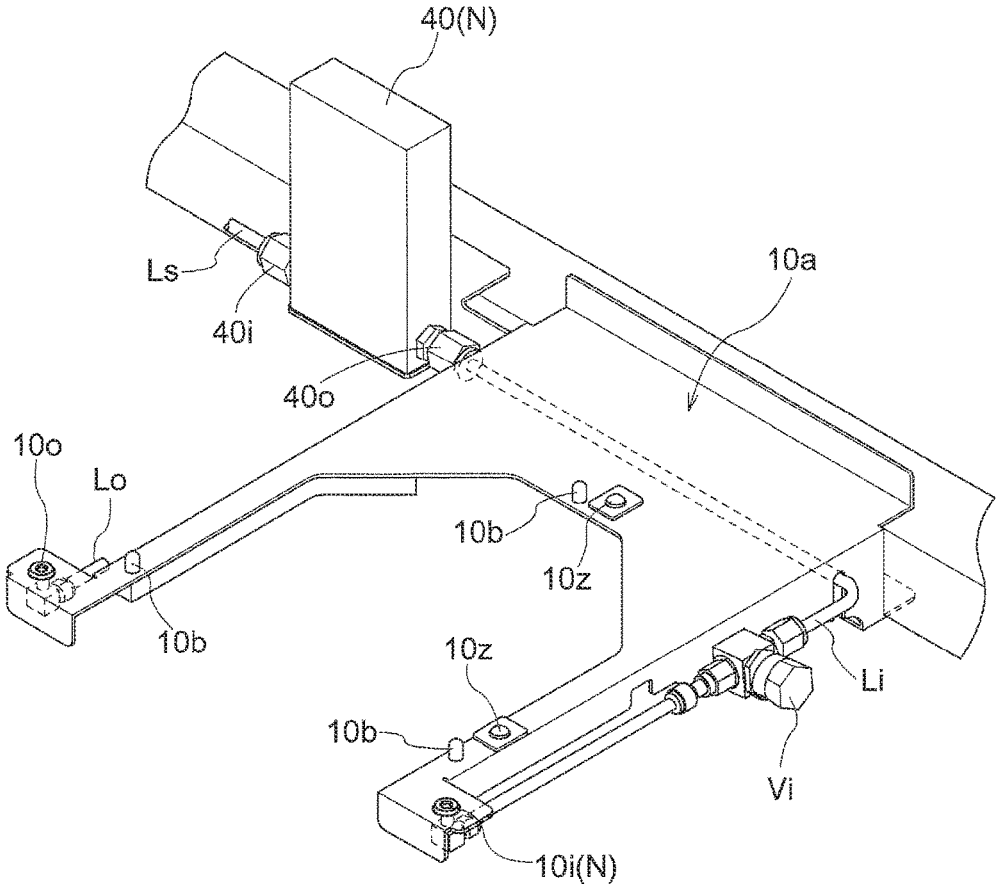
FIG. 3 is a perspective view of a storage section in accordance with the embodiment of the present invention.

As shown in FIGS. 3 and 4, each of the plurality of storage sections 10S includes a plate-shaped receiving support portion 10*a* which receives and supports a container 50 (see FIG. 1).

This receiving support portion 10*a* is formed to have a U-shape in plan view to define space through which the support body 25A of the transfer device 25 can move vertically, and has the afore-described positioning pins 10*b* that stand erect on the top surface.

In addition, the receiving support portion 10*a* has a pair of container sensors 10*z* which detect whether a container 50 is placed on the receiving support portion 10*a* (i.e., whether a container 50 is stored in the storage section 10S). And detected information from these sensors 10*z* is input into the introducing controller H (see FIG. 4) which manages operation of the mass flow controller 40 described below.

2. Introducing Portion N

Each introducing portion N is configured to act on a container 50 which is capable of discharging gas within the container 50 into the storage space through its gas discharge opening 50*o* when stored in the storage section 10S, and is configured to introduce, or inject, nitrogen gas as the inactive gas into the interior of such container 50 through the gas feed opening 50*i* of the container 50.

In the present embodiment, each introducing portion N includes, as its principal components, a nitrogen gas supply source, a mass flow controller 40, and a discharge nozzle 10*i*.

The receiving support portion 10*a* has the discharge nozzle 10*i* for supplying the nitrogen gas as inactive gas to the interior of the container 50, and a discharging gas passage body 10*o* for allowing the gas discharged from the interior of the container 50 to flow through. And each storage section 10S is equipped with the mass flow controller 40 which controls supply, or feeding, of nitrogen gas (see FIG. 2).

And a feed pipe Li which the nitrogen gas from the mass flow controller 40 flows through is connected to the discharge nozzle 10*i* whereas a discharge pipe Lo with an open end is connected to the discharging gas passage body 10*o*.

Thus, when a container 50 is received and supported by the receiving support portion 10*a*, the discharge nozzle 10*i* fits into, and becomes connected to, the gas feed opening 50*i* of the container 50, and the discharging gas passage body 10*o* fits into, and becomes connected to, the gas discharge opening 50*o* of the container 50.

And with the container 50 received and supported by the receiving support portion 10*a*, and by discharging nitrogen gas having pressure greater than the atmospheric pressure by a preset value, through the discharge nozzle 10*i*, nitrogen gas can be introduced or injected into the interior of the container 50 through the gas feed opening 50*i* of the container 50 while gas in the container is forced and discharged out from the gas discharge opening 50*o* of the container 50.

Also, as shown in FIG. 3, the feed pipe Li has a manually-operated opening and closing valve Vi so that the supply of nitrogen gas can be stopped in an emergency etc., such as when the mass flow controller 40 fails.

<Mass Flow Controller 40>

As shown in FIGS. 3 and 4, the mass flow controller 40 includes an introducing side port 40*i* and a discharging side port 40*o*. And the feed pipe Li described above is connected to the discharging side port 40*o* whereas an inflow pipe Ls for guiding the nitrogen gas from nitrogen gas supply sources (not shown), such as a nitrogen gas container, is connected to the introducing side port 40*i*.

And the nitrogen gas supply source includes, among other things, a governor for adjusting the supply pressure of the nitrogen gas to the set pressure which is greater than the atmospheric pressure by the preset value, and a manually-operated opening and closing valve with which supply of nitrogen gas can be allowed or interrupted.

The mass flow controller 40 includes a flow rate adjusting valve for adjusting the flow rate (supply flow rate to the container 50) of the nitrogen gas that flows through an internal passage which extends from the introducing side port 40*i* to the discharging side port 40*o*, a flow rate sensor for measuring the flow rate (supply flow rate to the container 50) of the nitrogen gas which flows through the internal passage; and an internal control unit for controlling the operation of the flow rate adjusting valve.

And the internal control unit is configured to control the flow rate adjusting valve based on the detected information from the flow rate sensor, in order to adjust the supply flow rate to the container 50 to match the target flow rate commanded by the introducing controller H.

In the present embodiment, the mass flow controller 40 can adjust the flow rate (supply flow rate to the container 50) of the nitrogen gas that flows through the internal passage from zero to 50 liters/min. And the mass flow controller 40 used in the present embodiment is configured to be able to adjust the flow rate to the target flow rate commanded by the introducing controller H very quickly (for example, within 1 second) over the entire adjustable range of the flow rate.

3. Introducing Controller H 3-1. Normal Supply Control When Maintenance Door 55 is Closed The introducing controller H is a controller that performs introducing control in which supply of the nitrogen gas to the container 50 is controlled by controlling the operation of the introducing portion N based on a supply pattern which is defined by predetermined parameters.

The introducing controller H includes an arithmetic processing unit, such as one or more CPUs, as a core component as well as memory device, such as RAM (random access memory) which the arithmetic processing unit can read data from and can store, or write, data to, and ROM (read only memory) from which the arithmetic processing unit can read data. And each functional component of the introducing controller H is formed by one or both of software (program) stored in ROM, etc. of the introducing controller H and hardware, such as an arithmetic circuit provided separately.

In the present embodiment, the introducing controller H includes a computer C and a programmable logic controller P as shown in FIG. 4. The programmable logic controller P is connected to each mass flow controller 40, and commands a target flow rate to the mass flow controller 40 provided to, or installed in association with, each of the plurality of storage sections 10S.

The computer C includes a main arithmetic processing functional unit—which performs overall introducing control—of the introducing controller H. The computer C commands a target flow rate to the mass flow controller 40 provided to, or installed in association with, each of the plurality of storage sections 10S through the programmable logic controller P.

A control panel HS for outputting and inputting various kinds of information and a display DS are connected, as user interface, to the computer C. The control panel HS and the display DS are preferably attached to an external wall surface of the storage rack 10. In that case, it is preferable to install them at a height, corresponding to the height of the workers, from the floor surface.

In the present embodiment, the introducing controller H is configured to separately set the supply pattern for each introducing portion N (mass flow controller 40) associated with each container 50 stored in the storage section 10S.

In addition, in the present embodiment, the introducing portion N is configured to be able to supply nitrogen gas to the discharge nozzle 10*i* for introducing nitrogen gas into the container 50, even when no container 50 is stored in the storage section 10S. And the introducing portion N is configured to separately set the supply pattern also for each introducing portion N associated with the storage section 10S in which no container 50 is stored.

The introducing controller H is configured to control the supply of the nitrogen gas to the discharge nozzle 10*i* by controlling the operation of each introducing portion N (mass flow controller 40) based on the supply pattern set for each introducing portion N (mass flow controller 40), regardless of whether a container 50 is stored.

Each supply pattern is a pattern for the supply flow rate of nitrogen gas. As shown in FIG. 5, the supply pattern includes a pattern for changes in the target flow rate with respect to time. The relationship between the elapsed time from the supply start time and the target flow rate is defined, or dictated by certain parameters. For example, the parameters may be provided in the form of table data that define the relationship between elapsed time and the target flow rate. The supply patterns includes one in which the target flow rate is not changed with the passage of time, i.e., a pattern that maintains the target flow rate at a constant value.

Also, the supply pattern, in some cases, is a pattern for changes in the target flow rate, which is triggered by fulfillment of predetermined conditions, or events (referred to as an event triggered supply pattern).

The data that defines the relationship between the elapsed time and the target flow rate, and the events (conditions) are the parameters that define the supply pattern. And the supply pattern can be changed by operation of the control panel HS by a worker, and also by remote control by the management system as described below.

In the present embodiment, the introducing controller H can be switched between an automatic operation mode and a manual operation mode. The operation mode is changed through operation by a worker, or by remote control from the outside.

<Automatic Operation Mode>

When in the automatic operation mode, the introducing controller H is configured to set an event triggered supply pattern. In the present embodiment, a plurality of events, and a pattern for changes in the target flow rate corresponding to each event are provided. Each pattern for changes in the target flow rate is defined by the data which define the relationship between the elapsed time and the target flow rate.

In the present embodiment, an initial purge pattern, a storage purge pattern, or a nozzle purge pattern etc., is set as an event triggered supply pattern in the automatic operation mode.

Figure 5A:
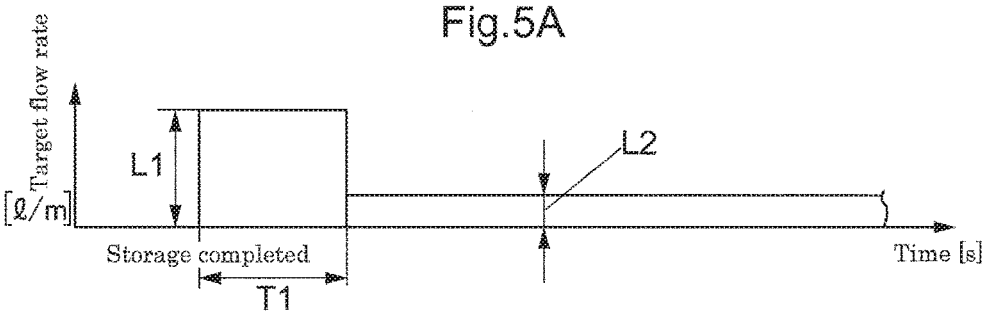
FIG. 5A through FIG. 5D are explanatory drawings showing supply patterns in accordance with the embodiment of the present invention.
Figure 5B:
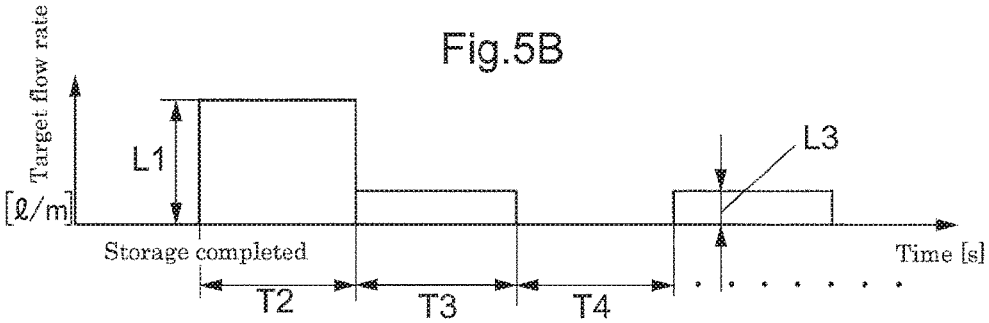

The initial purge pattern is a pattern in which an event is considered to have been fulfilled when it is determined that a container 50 has just been stored in the storage section 10S based on a detection signal from the container sensor 10*z*, and, is, for example, a pattern in which, as shown in FIGS. 5A and 5B, the initial target flow rate (L1) is set to be a large flow rate for an initial period (T1) in order to quickly fill the inside of the container 50 with nitrogen gas.

The storage purge pattern is a pattern in which an event is considered to have been fulfilled when the initial purge pattern is completed, and is, for example, a pattern in which the storage target flow rate is continuously set to be a comparatively low flow rate (L2) in order to keep the inside of the container 50 filled with nitrogen gas (see FIG. 5A), or a pattern in which a cycle is repeated in which the target flow rate is set to zero for an OFF period (T4) after having a storage target flow rate (L3) for an ON period (T3).

Figure 5C:
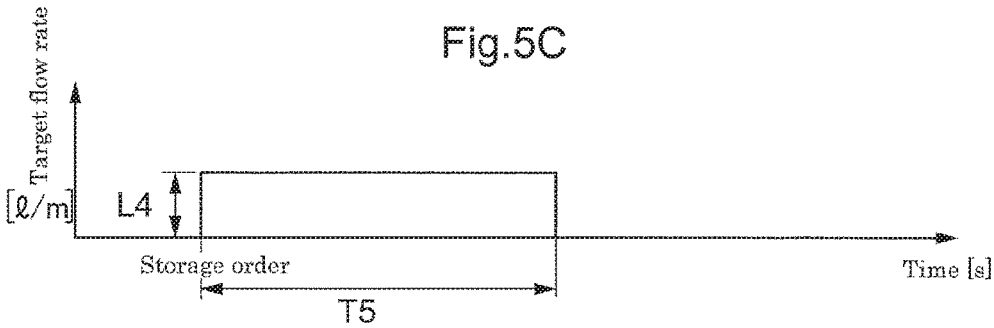

The nozzle purge pattern is a pattern in which an event is considered to have been fulfilled when a container 50 is carried into the carry-in-and-out conveyor CV and a storage section 10S in which the container 50 is to be stored is decided, and is, for example, a pattern in which, as shown in FIG. 5C, a nozzle cleaning target flow rate for cleaning the discharge nozzle 10*i* (L4) is set for the duration of a cleaning period (T5) immediately before the container 50 is stored in the storage section 10S.

These initial target flow rate (L1), the storage target flow rate (L2, L3), the nozzle cleaning target flow rate (L4), the initial period (T1), the ON period (T3), the OFF period (T4) and the cleaning period (T5), and each event (condition) are the parameters that define the supply pattern.

<Manual Operation Mode>

When in the manual operation mode, the introducing controller H is configured to set a normal supply pattern which is not triggered by an event.

In the present embodiment, a plurality of predetermined supply patterns, such as a direct-input pattern, a stop pattern, a cleaning pattern, etc., are provided as the supply pattern set in the manual operation mode. And any one of the plurality of predetermined supply patterns is selected by operation by a worker, or by remote control from outside, and is set as the supply pattern. Each predetermined supply pattern is defined by parameters that define the relationship between elapsed time and the target flow rate.

The direct-input pattern is one in which a manual target flow rate is set continuously through operation of the control panel HS by a worker, or by remote control by the management system.

The stop pattern is a pattern in which the target flow rate is continuously set to zero.

Figure 5D:
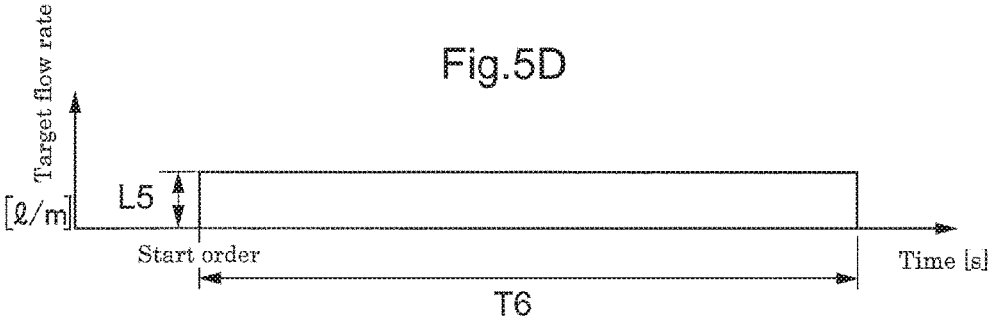

The cleaning pattern, as shown in FIG. 5D, is a pattern in which a cleaning target flow rate (L5) for cleaning is set for the duration of a cleaning period (T6) at the time of the installation of the storage rack 10, or when the introducing portion N needs to be replaced, etc.

The manual target flow rate, the cleaning target flow rate (L5), and the cleaning period (T6) are the parameters that define the supply pattern.

In addition, the selected setting between the automatic operation mode and the manual operation mode, as well as the selected setting among the direct-input pattern, the stop pattern, and the cleaning pattern, in the manual operation mode are also the parameters that define the supply pattern.

In addition, the initial purge pattern, the storage purge pattern, the nozzle purge pattern, the cleaning pattern, etc. are examples. And any desired patterns for the changes in the target flow rate or events (conditions) may be used.

3-2. Supply Control When Maintenance Door 55 is Open

As shown in FIGS. 2 and 4, the inactive gas introducing facility 1 includes an inspection door open-and-close detection sensor S1 which functions as an inspection door open-and-close detector for detecting whether the inspection door 55 is in an open state or closed state, and a stop nullifying command switch SW as a manually-operated stop nullifying command portion which issues a stop nullifying command.

<Maintenance Door Opening-and-Closing Detection Sensor S1>

The inspection door open-and-close detection sensor S1 includes, among other things, a limit switch which is operated by a pressing force by the inspection door 55, and is configured to detect whether the inspection door 55 is in a closed state in which the door 55 is in a fully closed position or in an open state in which the inspection door 55 is operated on, or moved, from the fully closed position toward its open position, and to output the detected information to the introducing controller H.

<Stop Nullifying Command Switch SW>

The stop nullifying command switch SW is installed in such a position that the switch SW can be operated before a worker opens the inspection door 55 and enters the storage space, for example, on the outside of a wall K and near the inspection door 55, as shown in FIG. 2.

As shown in FIG. 4, the stop nullifying command switch SW is configured to be operated by operating, or turning, the operating member 56 to an operation release position A or to a nullifying command position B. The stop nullifying command switch SW is configured to issue a stop nullifying command to the introducing controller H when the operating member 56 is operated, or turned to, to the nullifying command position B, and not to issue the stop nullifying command to the introducing controller H when the operating member 56 is operated, or turned, to the operation release position A.

In the present embodiment, the operating member 56 is urged back toward the operation release position A by a resilient member, such as a spring so that the operating member would return to the operation release position A when released. This arrangement prevents a situation unintended by the worker where supply of nitrogen gas is not stopped when the inspection door 55 is opened with the operating member 56 left in the nullifying command position B.

As the operating member 56, a removable key which may be removed from and inserted into the switch SW, as shown in FIG. 4, can be used, or so-called selector switch whose knob is permanently attached to the switch SW may be used.

3-2-1. Setting of Normal Stop State and Stop Nullifying State

In the present embodiment, the introducing controller H is configured to basically set the stop mode to the stop nullifying state when it determines that the stop invalid state is desired based on the stop nullifying command issued from the stop nullifying command switch SW, and to set the stop mode to the normal stop state when it determines that the normal stop state is desired based on the stop nullifying command switch SW not issuing the stop nullifying command.

In the present embodiment, the introducing controller H is configured to cancel the stop nullifying state and to switch the stop mode to the normal stop state if the open state of the inspection door 55 is not detected by the inspection door open-and-close detection sensor S1 within a set period (for example, 5 minutes) defined in advance after setting the stop mode to the stop nullifying state. In other words, unnecessary continuance of the stop nullifying state can be avoided when, for example, after operating the stop nullifying command switch SW to perform inspection work, the worker decides not go forward with the inspection work.

In addition, in the present embodiment, since the operating member 56 is urged back toward the operation release position A as described above, the operating member 56 is automatically returned to the operation release position A when a worker releases the operating member 56 after operating it to the nullifying command position B, and enters the storage space, so that the stop nullifying command switch SW does not continue issuing the stop nullifying command.

Thus, in the present embodiment, the introducing controller H is configured to set the stop mode to the stop nullifying state when the stop nullifying command is issued from the stop nullifying command switch SW while the stop mode is set to the normal stop state, and to cancel, or release, the stop nullifying state and set the stop mode to the normal stop state when a release condition defined in advance is satisfied.

The release condition mentioned above is satisfied when the open state of the inspection door 55 is not detected by the inspection door open-and-close detection sensor S1 within a set period defined in advance after setting the stop mode to the stop nullifying state, or when the open state of the inspection door 55 is detected by the inspection door open-and-close detection sensor S1 before the set period defined in advance elapses after setting the stop mode to the stop nullifying state and thereafter the closed state of the inspection door 55 is detected.

3-2-2. Supply Control in Normal Stop State When the open state of the inspection door 55 is detected by the inspection door open-and-close detection sensor S1 while in the normal stop state which is the state in which the stop nullifying command is not issued from the stop nullifying command switch SW, the introducing controller H is configured to stop the supply control of nitrogen gas based on an immediately preceding supply pattern which is the supply pattern which was being performed to each introducing portion N before the open state of the inspection door 55 was detected, and to control operation of each introducing portion N to forcibly, or unconditionally, stop the supply of the nitrogen gas to all the containers 50. In the present embodiment, the supply of nitrogen gas is stopped for all of the introducing portions N. (mass flow controllers 40) regardless of whether the container 50 is stored.

In the present embodiment, the .introducing controller H stops set control of the target flow rate for each mass flow controller 40 based on the immediately preceding supply pattern, and sets the target flow rate commanded to all the mass flow controllers 40 to zero to forcibly, or unconditionally, cause all the flow rate adjusting valves for supplying nitrogen gas to be closed. In this case, any changes in the parameters that define the supply pattern, through operation by a worker (manual operation), or by remote control from outside, are prohibited. This prevents the resumption of the nitrogen gas supply by a cancellation of the forceful, or unconditional, stoppage of the supply.

In the present embodiment, when the open state of the inspection door 55 is detected while in the normal stop state, the introducing controller H forcibly, or unconditionally, sets the operation mode of all the mass flow controllers 40 to the manual operation mode and also sets the supply pattern to the stop pattern to set the target flow rate for all the mass flow controllers 40 to zero. And the introducing controller H prevents any changes in the preset value of the target flow rate in the stop pattern, the setting of the operation mode, the selection of the preset supply pattern, etc. through operation by a worker, or by remote control from outside by locking these values and modes.

<Restoring Process>

When the introducing controller H determines that the inspection door 55 is in the closed state, the introducing controller H is configured: to end the stoppage of the supply of nitrogen gas; to resume supply control of nitrogen gas based on the immediately preceding supply pattern; to cancel the prohibition of any changes in the parameters that define the supply pattern; and to start accepting any changes in the parameters.

In the present embodiment, the introducing controller H is configured to determine that the inspection door 55 is in the closed state when the closed state of the inspection door 55 is detected by the inspection door open-and-close detection sensor S1.

Alternatively, the introducing controller H may be configured to determine that the inspection door 55 is in the closed state when the closed state of the inspection door 55 is detected by the inspection door open-and-close detection sensor S1 and a worker performs a release operation for canceling the stoppage of supply of nitrogen gas, by means of the control panel HS. By requiring such confirmation operation of the control panel HS by a worker, resumption of supply of nitrogen gas can be prevented when the inspection door 55 is closed while a worker is in the storage space.

3-2-3. Supply Control in Stop Nullifying State

On the other hand, when the open state of the inspection door 55 is detected by the inspection door open-and-close detection sensor S1 while in the stop nullifying state which is the state in which the stop nullifying command is issued from the stop nullifying command switch SW, the introducing controller H is configured to maintain the supply of nitrogen gas based on the immediately preceding supply pattern which is the supply pattern which has been performed to each introducing portion N before the open state of the inspection door 55 was detected, and to prohibit any manually effected changes in any parameters that define the immediately preceding supply pattern.

In the present embodiment, the introducing controller H maintains the immediately preceding supply pattern that was set for each of all the mass flow controllers 40 regardless of whether the container 50 is stored. And the introducing controller H is configured to set the target flow rate for each mass flow controller 40 based on its immediately preceding supply pattern.

For example, if automatic operation mode was set and the initial purge pattern, the storage purge pattern, and the nozzle purge pattern were set for a certain mass flow controller 40 before the open state of the inspection door 55 was detected, the introducing controller H maintains the state in which the automatic operation mode is set and the initial purge pattern, the storage purge pattern, and the nozzle purge pattern are set after the open state of the inspection door 55 is detected, and continues to set the target flow rate for the mass flow controller 40 based on these immediately preceding supply patterns.

Or when the manual operation mode was set and the direct-input pattern was set for a certain mass flow controller 40 before the open state of the inspection door 55 is detected, the introducing controller H maintains the state in which the manual operation mode and the direct-input pattern are set after the open state of the inspection door 55 is detected, and continues to set the target flow rate for the mass flow controller 40 based on this direct-input pattern.

And in the present embodiment, by locking the parameters, the introducing controller H prevents any changes to the parameters that define the immediately preceding supply pattern for each mass flow controller 40, through operation of the control panel HS by a worker.

In the present embodiment, the parameters that are locked and prevented from being changed are data that specifies the relationship between elapsed time and the target flow rate, such as the initial target flow rate and the initial period, that define the supply pattern that has become the immediately preceding supply pattern, as well as events (conditions) such as that the container 50 has just been stored in a storage section 10S. Also, the parameters that are locked and prevented from being changed are the selected setting between the automatic operation mode and the manual operation mode, and the selected setting among the direct-input pattern, the stop pattern, the cleaning pattern in the manual operation mode.

While any changes by means of the control panel HS are prohibited and locked, the introducing controller H may cause the display DS to show a notification, or otherwise provide an audio notification, indicating that the supply of nitrogen gas is continued and any changes in the parameters are prohibited, such as " Worker in Storage Space After Stoppage of Supply of Nitrogen Gas Is Canceled: Prohibiting Any Changes to Supply Pattern of Nitrogen Gas".

This helps prevent a worker outside the storage space from changing the supply state of the nitrogen gas to each container 50 using the control panel HS installed outside the storage space without the knowledge of the worker in the storage space. Thus, for example, this would help prevent the oxygen concentration within the storage space from falling due to an increased supply flow rate of nitrogen gas without the knowledge of the worker in the storage space, or prevent the supply flow rate of nitrogen gas from being increased or decreased, which would disrupt an inspection process of the feed state of the nitrogen gas.

<Prohibition of Remote Control>

In the present embodiment, the introducing controller H is configured to be able to be remotely controlled by an external management system which is connected with the introducing controller H by means of a cable or wireless communication. And one introducing controller H is provided to each inactive gas introducing facility 1, and is located close to the associated inactive gas introducing facility 1. On the other hand, the management system is connected to each inactive gas introducing facility 1 by a communication network to centrally control a plurality of inactive gas introducing facilities 1, and is located relatively far from the inactive gas introducing facilities 1. The management system is configured to be able to remotely and forcibly control the operation of each introducing portion N in each inactive gas introducing facility 1, in place of the control by the introducing controller H.

To this end, the introducing controller H is also configured to prohibit any changes in the parameters that define the immediately preceding supply pattern by remote control from outside, when the open state of the inspection door 55 is detected during the stop nullifying state.

In the present embodiment, the introducing controller H locks, or prohibits any changes to, the parameters that define each immediately preceding supply pattern set for each mass flow controller 40 by remote control through the communication network by the external management system. The parameters that are locked, or prohibited from being changed, are the same as those in the case in which a worker attempts to make the changes as described above.

For example, the management system may be configured not to accept any operation to change the parameters for the corresponding inactive gas introducing facility 1. Or, even if the parameters for the corresponding inactive gas introducing facility 1 are changed in the management system, the introducing controller H may be configured not to accept any such changes. In such case, the management system may cause its display to show a notification, or otherwise provide an audible notification, as described above, to indicate that supply of the nitrogen gas is being continued and that no changes are accepted.

This would help prevent any changes in the supply state of the nitrogen gas to each container 50 from occurring without the knowledge of the worker at the inactive gas introducing facility 1.

<Notifying Member>

In the present embodiment, as shown in FIG. 4, the introducing controller H is configured to operate a wireless communication apparatus 57A which functions as a notifying member for notifying a worker of continuing supply of nitrogen gas when supply of the nitrogen gas to the container 50 is continued in the stop nullifying state.

In the present embodiment, the communication apparatus 57A is configured to send a message, indicating that supply of nitrogen gas is continued, to a mobile receiver 57B, such as a mobile phone carried by a worker. And the mobile receiver 57B is configured to display the received message on its display screen, or to provide an audio output, to notify a worker of the continued supply of nitrogen gas.

<Restoring Process>

When the introducing controller H determines that the inspection door 55 is in the closed state, the introducing controller H is configured: to continue the supply control of nitrogen gas based on the immediately preceding supply pattern; to cancel the prohibition of any changes in the parameters that define the supply pattern through operation by a worker (or manual operation) or by remote control from outside; to start accepting any changes to the parameters; and to stop the notification to the worker by the notifying member.

In the present embodiment, the introducing controller H is configured to determine that the inspection door 55 is in the closed state when the closed state of the inspection door 55 is detected by the inspection door open-and-close detection sensor S1, which is identical to the case of the normal stop state described above.

Alternatively, the introducing controller H may be configured to determine that the inspection door 55 is in the closed state when the closed state of the inspection door 55 is detected by the inspection door open-and-close detection sensor S1 and a worker performs a release operation for canceling the stoppage of supply of nitrogen gas, by means of the control panel HS, which is identical to the case of the normal stop state described above.

<Stoppage of Supply Due to Fall in Oxygen Concentration>

In the present embodiment, as shown in FIG. 2, the inactive gas introducing facility 1 has an oxygen concentration detection sensor S2 which detects the oxygen concentration within storage space which is closed off from the exterior by the walls K. And as shown in FIG. 4, the detected information from this oxygen concentration detection sensor S2 is input into the introducing controller H.

And if the oxygen concentration detected by the oxygen concentration detection sensor S2 becomes less than the preset value defined in advance while the supply of nitrogen gas is continued based on an immediately preceding supply pattern in the stop nullifying state, the introducing controller H is configured to stop the supply control of nitrogen gas based on the immediately preceding supply pattern, as in the normal stop state, and to control operation of each introducing portion N to forcibly, or unconditionally, stop the supply of the nitrogen gas to all the containers 50.

In the present embodiment, the introducing controller H is configured to cancel the stop nullifying state, and to set the stop mode to the normal stop state if the oxygen concentration becomes less than the preset value defined in advance in the stop nullifying state. With the cancelling of the stop nullifying state, the introducing controller H is shifted to a state in which the open state of the inspection door 55 is detected in the normal stop state; thus, the introducing controller H stops the supply control of nitrogen gas based on an immediately preceding supply pattern, and forcibly, or unconditionally, stops the supply of the nitrogen gas to all the containers 50.

Also in this case, any changes in the parameters that define the supply pattern, through operation by a worker (manual operation), or by remote control from outside, are prohibited.

In addition, a plurality of oxygen concentration detection sensors S2 may be installed so that they are distributed over different locations within the storage space. In this case, the introducing controller H may be configured to forcibly, or unconditionally, stop the supply of nitrogen gas as described above, if the oxygen concentration detected by any one of the plurality of oxygen concentration detection sensors S2 becomes less than a preset value.

3-3. Flow Chart

Figure 6:
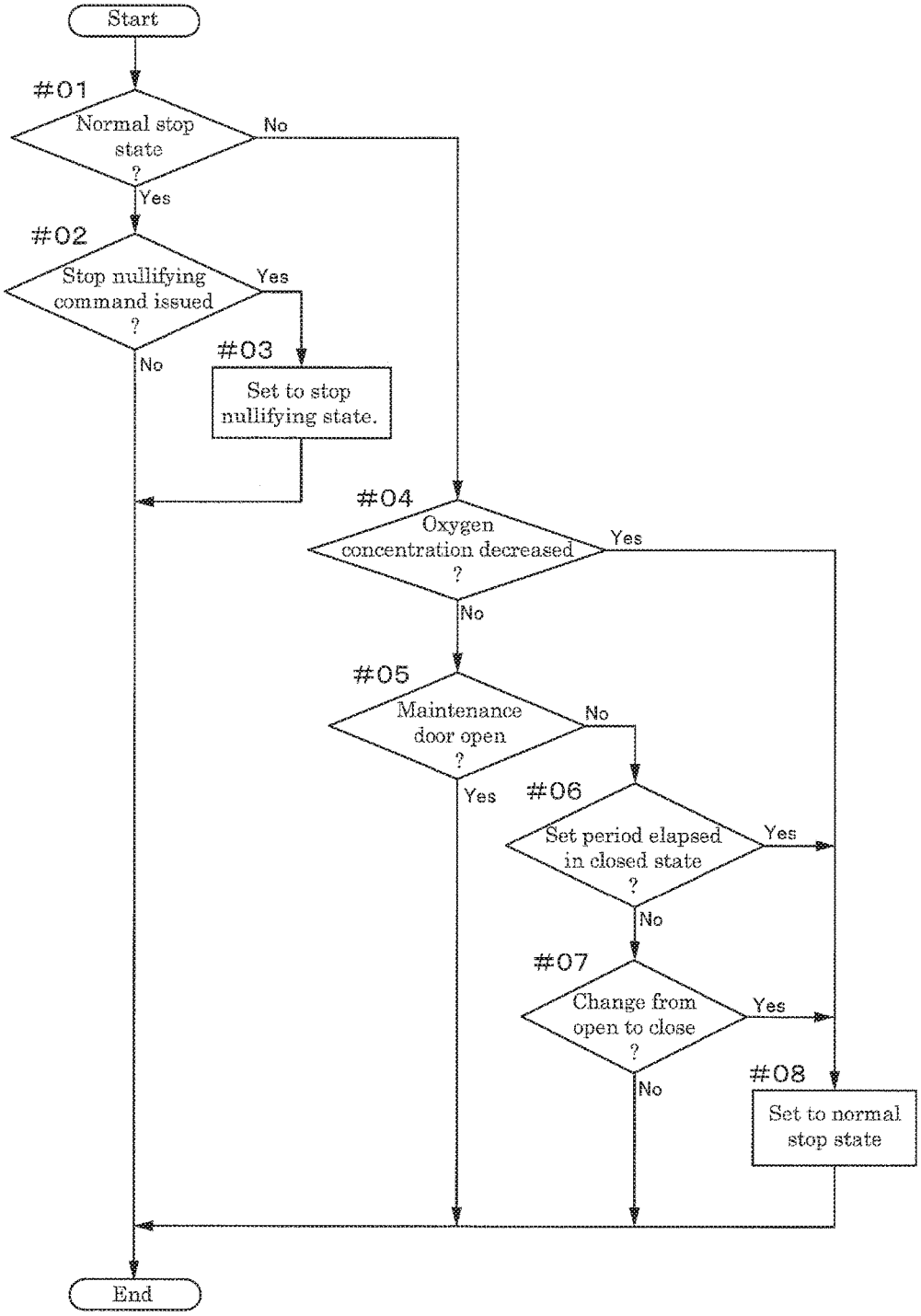
FIG. 6 is a flow chart for describing a process performed by the introducing controller in accordance with the embodiment of the present invention.
Figure 7:
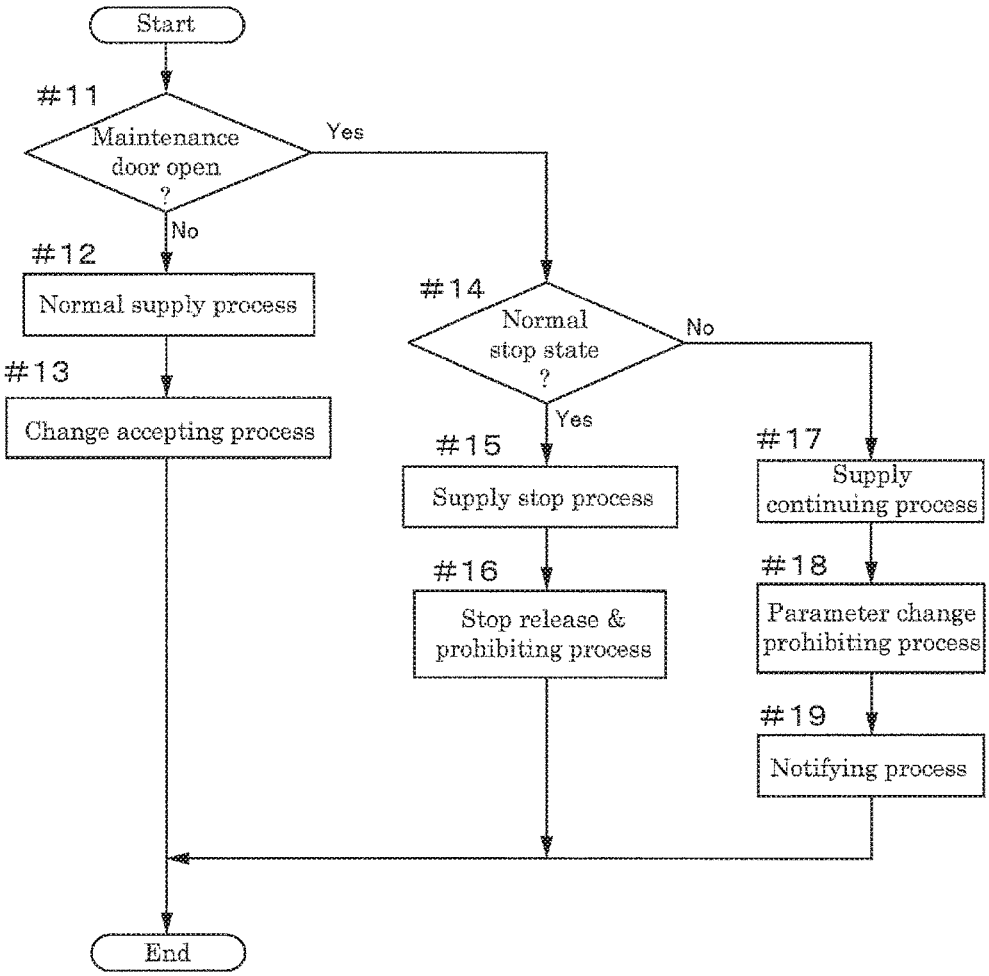
FIG. 7 is a flow chart for describing a process performed by the introducing controller in accordance with the embodiment of the present invention.

The supply control process of the nitrogen gas (inactive gas introducing method) in accordance with the present embodiment described above may be performed as illustrated in the example shown by the flow charts of FIGS. 6 and 7.

The flow chart of FIG. 6 shows how the normal stop state or the stop nullifying state is set whereas the flow chart of FIG. 7 shows the supply control process of nitrogen gas.

The introducing controller H is configured to perform and repeat the process shown in the flow charts of FIG. 6 and FIG. 7 at every predetermined calculating cycle (for example, 100 ms).

3-3-1. Setting of Normal Stop State or Stop Nullifying State

The flow chart of FIG. 6 is described first.

If the stop mode is set to the normal stop state (i.e., "Yes" in Step #01), the introducing controller H determines if stop nullifying command is issued by the stop nullifying command switch SW (Step #02). If the introducing controller H determines that the stop nullifying command is issued (i.e., "Yes" in Step #02), the introducing controller H sets the stop mode to the stop nullifying state (Step #03). On the other hand, if the introducing controller H determines that the stop nullifying command is not issued (i.e., "No" in Step #02), the introducing controller H leaves the setting of the stop mode in the normal stop state.

On the other hand, if the stop mode is set to the stop nullifying state (i.e., "No" in Step #01), the introducing controller H determines if the oxygen concentration detected by the oxygen concentration detection sensor S2 has become less than the preset value defined in advance (Step #04). If the introducing controller H determines that the oxygen concentration has become less than the preset value defined in advance (i.e., "Yes" in Step #04), the introducing controller H cancels the stop nullifying state, and sets the stop mode to the normal stop state (Step #08). On the other hand, if the introducing controller H determines that the oxygen concentration has not become less than the preset value defined in advance(i.e., "No" in Step #04), the introducing controller H determines if the open state of the inspection door 55 is detected by the inspection door open-and-close detection sensor S1 (Step #05). The introducing controller H leaves the stop mode in the stop nullifying state if it determines that the inspection door 55 is in the open state (i.e., "Yes" in Step #05).

If the introducing controller H determines that the inspection door 55 is in the closed state (Step #05: No), the introducing controller H determines whether a set period defined in advance has elapsed after the stop nullifying state was set with the inspection door 55 remaining in the closed state (Step #06). If the introducing controller H determines that the set period defined in advance has elapsed with the inspection door 55 remaining in the closed state (i.e., "Yes" in Step #06), the introducing controller H cancels the stop nullifying state and sets the stop mode to the normal stop state (Step #08).

If the introducing controller H determines that the set period defined in advance has not elapsed with the inspection door 55 remaining in the closed state (i.e., "No" in Step #06), the introducing controller H determines if the state of the inspection door 55 changed from the open state to the closed state (Step #07). More specifically, the introducing controller H determines if the inspection door 55 was detected to be in the open state during the last calculating cycle, and if the inspection door 55 is detected to be in the closed state in the current calculating cycle. If the introducing controller H determines that the state of the inspection door 55 changed from the open state to the closed state (i.e., "Yes" in Step #07), the introducing controller H cancels the stop nullifying state and sets the stop mode to the normal stop state (Step #08). If the introducing controller H determines that the state of the inspection door 55 has not changed from the open state to the closed state (i.e., "No" in Step #07), the introducing controller H leaves the stop mode in the stop nullifying state.

3-3-2. Supply Control Process of Nitrogen Gas

The flow chart of FIG. 7 is described next.

The introducing controller H determines if the inspection door 55 is in the open state or is in the closed state in Step #11. In the present embodiment, if the detected information from the inspection door open-and-close detection sensor S1 indicates that the state of the inspection door 55 changed from the closed state to the open state, the introducing controller H is configured to set the state of the opening-and-closing state of the inspection door 55 to the open state and determines the inspection door 55 to be in the open state.

After that, if the closed state of the inspection door 55 is detected by the inspection door open-and-close detection sensor S1, and the release operation is performed by a worker by means of the control panel HS, the introducing controller H is configured to set the state of the opening-and-closing state of the inspection door 55 to the closed state and determines the inspection door 55 to be in the closed state.

If the inspection door 55 is determined to be in the closed state (i.e., "No" in Step #11), the introducing controller H controls the operation of the introducing portion N based on the supply pattern defined by the predetermined parameters to perform the normal supply process in which the supply of the nitrogen gas to the container 50 is controlled (Step #12). If there is a request to make any changes in the parameters that define the supply pattern, through operation by a worker (manual operation), or by remote control from outside, the introducing controller H performs an accepting process in which changes in the parameters are accepted.

On the other hand, if the inspection door 55 is determined to be in the open state (i.e., "Yes", in Step #11), the introducing controller H proceeds to Step #14. If the stop mode is set to the normal stop state (i.e., "Yes" in Step #14), the introducing controller H stops the supply control of nitrogen gas based on the immediately preceding supply pattern, and performs a supply stop process in which the forcible, or unconditional, supply of nitrogen gas is stopped (Step #15). And the introducing controller H prohibits any changes in the parameters that define the supply pattern, through operation by a worker (manual operation), or by remote control from outside, and performs a process in which canceling of stoppage of supply of nitrogen gas is prohibited.

If the stop mode is set to the stop nullifying state (i.e., "No" in Step #14), the introducing controller H performs a process in which the supply control of nitrogen gas to each container 50 based on the immediately preceding supply pattern is continued (Step #17). And the introducing controller H performs a process in which any changes in the parameters that define the supply pattern, through operation by a worker (manual operation), or by remote control from outside, are prohibited (Step #18). In addition, the introducing controller H performs a process in which a worker is notified of continued supply of nitrogen gas by the notifying member (Step #19).

[Other Embodiments]

Finally, other embodiments of the present invention are described. The arrangements or configuration of each embodiment described below is not limited to be implemented by itself, but it is also possible to implement such arrangements or configuration in combination with those of other embodiments in the absence of any inconsistency.

(1) In the embodiment described above, while an example is described in which nitrogen gas is used as the inactive gas, various gas, such as argon, may be used as inactive gas. In addition, the inactive gas in the present invention needs to be gas with low oxygen content and low absolute humidity.

(2) In the embodiment described above, an example is described in which the introducing portion N includes, as its principal components, the nitrogen gas supply source, the discharge nozzle 10*i*, and the mass flow controller 40, that is, in which the introducing portion N utilizes the mass flow controller 40. However, for example, a configuration may be implemented in which the mass flow controller 40 is not utilized, and in which a flow rate adjusting valve which varies and adjust the supply flow rate to the container 50, and a flow rate sensor which measures the supply flow rate to the container 50 are provided in the feed passage for the nitrogen gas; and the introducing controller H controls the operation of the flow rate adjusting valve based on the detected information from the flow rate sensor.

In this case, the introducing portion N includes, as its principal components, a nitrogen gas supply source, the discharge nozzle 10*i*, and the flow rate adjusting valve.

(3) In the embodiment described above, when the inspection door 55 is opened in the normal stop state, the supply of the nitrogen gas to the container 50 is stopped by stopping the supply of nitrogen gas by means of the mass flow controller 40 provided to, or in association with, each of the plurality of storage sections 10S. However, various other arrangements can be adapted for stopping the supply of nitrogen gas to the container 50. For example, the supply of the nitrogen gas to the container 50 can be stopped by closing a supply on-off valve provided to the nitrogen supply source.

(4) In the embodiment described above, an example is described in which a communication apparatus 57A which transmits a message to a worker's mobile receiver 57B is used as the notifying member which notifies a worker of continued supply of inactive gas. However, a specific arrangement for the notifying member may be different from this. For example, a loudspeaker which provides an audible message may be installed near the inspection door 55 as a notifying member.

(5) In the embodiment described above, the operating member 56 is urged back toward the operation release position A by means of a resilient member, such as a spring; however, the operating member 56 does not have to be urged back toward the operation release position A.

(6) In the embodiment described above, the stop nullifying command portion is the mechanical stop nullifying command switch SW. However, the stop nullifying command portion may include an electronic switch which may be operated by means of a touch panel, or a control panel HS, or by inputting a password.

What is claimed is:

1. An inactive gas introducing facility comprising:

a storage rack including a storage section for storing a container for storing a substrate, the storage rack being installed in a storage space which is closed off from exterior space;

an introducing portion configured to act on the container which is capable of discharging gas inside the container into the storage space through a gas discharge opening when stored in the storage section, and configured to introduce inactive gas into an interior of the container through a gas feed opening of the container;

an introducing controller for controlling supply of the inactive gas to the container by controlling an operation of the introducing portion based on a supply pattern defined by a predetermined parameter;

an inspection door open-and-close detector for detecting whether an inspection door for allowing a worker to go in, and out of, the storage space is in an open state or a closed state;

a manually-operated stop nullifying command portion for issuing a stop nullifying command, wherein the introducing controller is configured:

to stop the supply of the inactive gas to the container by stopping supply control of inactive gas based on an immediately preceding supply pattern which is the supply pattern that was being performed before the open state of the inspection door was detected, if the open state of the inspection door is detected by the inspection door open-and-close detector while in a normal stop state in which the stop nullifying command is not issued from the stop nullifying command portion, and to continue with the supply of the inactive gas based on the immediately preceding supply pattern and to prohibit any changes, through manual operation, to the parameter that defines the immediately preceding supply pattern if the open state of the inspection door is detected by the inspection door open-and-close detector while in a stop nullifying state in which the stop nullifying command is issued from the stop nullifying command portion.

2. The inactive gas introducing facility as defined in claim 1, wherein the introducing controller is further configured to prohibit any changes, by remote control from outside, to the parameter that defines the immediately preceding supply pattern if the open state of the inspection door is detected while in the stop nullifying state.

* * * * *